US011465300B2

(12) United States Patent
Demko

(10) Patent No.: US 11,465,300 B2
(45) Date of Patent: Oct. 11, 2022

(54) POLYMER BALISONG KNIFE AND LATCH FOR A BALISONG KNIFE

(71) Applicant: Cold Steel, Inc., Ventura, CA (US)

(72) Inventor: Andrew Demko, Wampum, PA (US)

(73) Assignee: GOOD SPORTSMAN MARKETING, L.L.C., Irving, TX (US)

( * ) Notice: Subject to any disclaimer, the term of this patent is extended or adjusted under 35 U.S.C. 154(b) by 0 days.

(21) Appl. No.: 16/697,951

(22) Filed: Nov. 27, 2019

(65) Prior Publication Data

US 2021/0154867 A1 May 27, 2021

(51) Int. Cl.
*B26B 1/04* (2006.01)
*B26B 1/10* (2006.01)

(52) U.S. Cl.
CPC . *B26B 1/04* (2013.01); *B26B 1/10* (2013.01)

(58) Field of Classification Search
CPC ... B26D 1/04; B26D 1/10; B26D 1/00; B26D 1/02
See application file for complete search history.

(56) References Cited

U.S. PATENT DOCUMENTS

| | | | | |
|---|---|---|---|---|
| 229,706 | A | 7/1880 | Jansen | |
| 881,294 | A | 3/1908 | Billings | |
| 4,364,174 | A | 12/1982 | De Asis | |
| 4,648,145 | A | 3/1987 | Miceli | |
| 4,669,140 | A | 6/1987 | Miceli | |
| 6,195,898 | B1 * | 3/2001 | Lemisch | B26B 1/04 30/153 |
| 6,715,208 | B2 | 4/2004 | Lemisch | |
| 10,377,047 | B2 * | 8/2019 | Janovicz | B26B 1/04 |
| 2015/0224652 | A1 * | 8/2015 | Irvin | F41B 13/00 30/155 |

FOREIGN PATENT DOCUMENTS

| | | |
|---|---|---|
| CN | 103862484 | 4/2014 |
| CN | 108015812 | 12/2017 |
| FR | 572946 | 11/1923 |

* cited by examiner

*Primary Examiner* — Omar Flores Sanchez
(74) *Attorney, Agent, or Firm* — William F. Lang, IV; Lang Patent Law LLC

(57) ABSTRACT

A Balisong knife includes a latch that resists compression of the back end of the handles towards each other under grip pressure by the user, thus increasing the columns strength of the handles when the knife is in a latched open configuration. A crossmember is provided adjacent to the latch pivot, resisting movement of the latch into any position wherein interference between the latch and tip of the blade could occur. Integral, friction reducing surfaces are provided on components of the knife. The knife can be assembled using snap fit pivot pins. The blade includes portions of varying thickness, providing additional thickness in the region of the points for greater strength, while allowing center edges for more effective cutting.

12 Claims, 16 Drawing Sheets

POLYMER BALISONG KNIFE AND LATCH FOR A BALISONG KNIFE

TECHNICAL FIELD

The present invention relates to Balisong knives. More specifically, an improved latch for a Balisong knife is provided.

BACKGROUND INFORMATION

Balisong knives, which are also known as butterfly knives, consist of a blade which is pivotally attached to a pair of counter-rotating handles. When the knife is in a folded or closed configuration, one handle covers the front, typically sharpened edge of the blade, and the other covers the back, typically unsharpened edge of the blade. When the knife is in an unfolded or open configuration, the handles lie adjacent to each other, substantially parallel to the blade. The handles may be secured together using a T-shaped latch that is pivotally secured to the end of the handle corresponding to the sharpened edge (known as the bite handle), and which fits into a slot defined in the end of the other handle (known as the safe handle). Because the user's hand surrounds both handles, grip pressure also contributes to maintaining the knife in an open position, protecting the user from inadvertent closing of the knife. The knives have historically been used as tools and as defensive weapons. With training and practice, a balisong knife can be opened with one hand using various techniques known as "flipping." Today, these knives are also used for a variety of flipping techniques for artistic and entertainment purposes.

The vast majority of balisong knives available today are made from metal. However, it is sometimes desirable to manufacture knife handles from polymer, or to manufacture the entire knife from polymer. Polymer has the advantages of light weight, low cost, and resistance to electrostatic charges. When used for flipping, polymer also has the advantage of reduced inertia, making the use of a double edged balisong for flipping safer. However, making a balisong knife from polymer presents unique challenges which do not appear to have been overcome by the prior art. For example, when polymer handles are gripped by a user, the polymer may flex, increasing the likelihood of breaking the handle. A design that resists such flexing is therefore advantageous for maintaining the strength of the knife.

Other challenges are not unique to polymer balisongs. For example, resisting interference between the T-shaped latch and the blade of the knife is desirable regardless of the material from which the handles or blade are made. Decreasing friction between the blade and handles is always desirable for increasing the ease of flipping the knife. Minimizing cost without sacrificing quality of manufacture is always a desirable goal.

An example of a prior art balisong is U.S. Pat. No. 4,364,174, which discloses an apparatus and improved method of manufacturing handles for a butterfly defense knife. The method includes a series of steps of machining each handle section from a single piece of raw stock. The completed knife includes a tang that fits into depressions in the upper face of each handle section when the knife is in the open position. A latch is located adjacent the second end face of a lower handle section. The latch includes an elongated portion and a crossbar tip. A hole in the elongated portion permits the latch to be secured to the handle by a hinge pin. The crossbar tip comes in contact with the outward facing surface of the other handle section so that the two handles are held together. A friction fitting means (reference character 118, column 9, line 56—column 10, line 13, FIGS. 11 and 14) is placed within a hole within the elongated section of the latch so that it protrudes about ⅛ inch from the longitudinal surface of the elongated portion. The friction fitting means fits directly over the upper surface of the handle section holding the latch. The friction fitting means can be made from nylon, or can be a ball and spring assembly. The friction fitting means provides a solid close fit and assures that the handles will not fly open while the knife is carried in a closed position in a pocket or other container. The crossbar tip alone is asserted to be insufficient to assure this tight security. When the knife is in an opened position, the friction fitting means assures that the two handle sections remain together and do not fly apart on impact. As the knife is swung closed, the friction fitting means blocks the latch from falling into the plane of the slot and hitting the knife blade, preventing damage to the edge of the knife blade and the latch.

CN 103862484 discloses a foldable knife. The knife includes a blade that is pivotally attached to first and second rotating handles. Each handle includes a pair of handle plates that are held together by the hinge pins connecting the blade as well as pins on the opposite end of the handle. The blade includes pins, called a front fixing column and rear fixing column, on either side of the tail end of the blade to interface with the handle in both the open and closed position, keeping the handles symmetrical in both the open and closed positions.

CN 105015812 discloses a butterfly knife with a hidden latch. The knife includes a blade having a pair of nice housings pivotally connected to the blade. Each knife housing includes an upper knife housing and the lower knife housing. The knife includes a latch having a latch handle and a pair of chuck members mounted inside one of the housings, between the upper and lower housing portion. When the knife is to be locked in a closed position, the chuck members are rotated to cooperate with a slot in the other knife housing. A miniature motor controls movements of the chuck members. The motor is controlled by a controller that is actuated by a trigger switch.

FR 572,946 discloses a knife having a blade and a pair of handles pivotally attached thereto. A 10 adjacent to the handle pivots fits between the handles when the knife is in the open position, limiting the movement of the handles with respect to the blade. A pivoting latch on the opposite end of the handles holds the handles together.

U.S. Pat. No. 229,706 discloses a clasp knife. The knife includes a blade having a tang with two pivot holes. A haft made from two outer shells, each of which is pivotally attached to the blade. One of the outer shells includes a spring latch pivotally secured at its lower end. The spring latch includes a projection or lip which, when the spring latch is placed over the opposite shell, holds the two sections together. A pen projecting from opposite sides of the tang services a stop for the outer shells, holding the blade rigidly in position with respect to the haft sections when the knife is open.

U.S. Pat. No. 881,994 discloses a knife. Having a blade with a pair of outwardly projecting hand guards. A pair of tubes are pivotally attached to the tang of the blade. Each of the tubes includes a slot along one side for receiving the edge of the blade. A pair of pens are disposed on the tang between the pivoted ends of the tubes, so that regardless of whether the knife is in the open or closed position, one of the pens is between the tubes. A catch is hinged to the outer end of one of the tubes. The catch has a spring catch that extends over and engages a notch in the outer end of the other tube.

U.S. Pat. No. 4,648,145 discloses a folding pocket tool and knife. The knife blade includes a butt end with a pair of handles pivotally connected thereto. Each handle includes a slot formed between a pair of liners, with each liner being secured to the inside of its associated handle leg. A block that is pivotally secured to one handle includes a can be affixed to a pin in the opposing handle to secure the handles together. These latch pins also extend from either side of the handle so that they form a spanner wrench between the pins on either side of the handle. Each handle includes a cutout through which a toothed liner protrusion extends for nut-cracker type gripping of pliers. The teeth are staggered to allow them to intermesh when the handles are closed. A wire cutter is defined between the handles, providing an aperture through which wire can be positioned for cutting. The knife blade includes a slot for engaging and turning faceted fasteners. The butt end of the knife blade includes three screwdriver heads, with two on either side, with the pivots therebetween, and a third across the butt end of the blade. Tool holding provisions are included in the latch end of the handles, for holding another tool when the knife is in a closed position. U.S. Pat. No. 4,689,140 is a continuation in part of U.S. Pat. No. 4,648,145. This patent discloses additional and improved tool attachment devices.

U.S. Pat. No. 6,715,208 discloses a thumb lock for a butterfly knife. The knife includes a blade having handles pivotally attached to the proximal end of the blade. The locking plate is secured to a proximal portion of one of the handles. The locking plate includes an open end and a closed end, each of which includes a ridged edge. The second handle includes a notch for receiving the ridged edge of the locking plate on both the opening surface and the closing surface. The knife is locked in either position by the engagement of the locking plate with the appropriate notch. A second embodiment includes a slidable magnetic component in one handle, and a fixed magnetic component in the other handle. The slidable magnetic component is spring biased into a position wherein it will engage the fixed magnetic component with the handles in the open or closed position. A thumb switch is used to slide the movable magnet away from the fixed magnet to separate the handles.

As the above descriptions show, the vast majority of the design efforts directed towards balisong knives has been directed towards metallic knives, and thus fail to address the unique challenges of polymer knives or polymer knife handles. Accordingly, design features which resist compression of the handles when the knife is gripped by a user would contribute to the strength of the handles. Furthermore, latch designs which resist interference between the latch and blade, as well as friction-reducing design features, are useful regardless of the materials from which the knife is made.

SUMMARY

The above needs are met by a knife. The knife comprises a first handle and a second handle, with each of the first handle and second handle defining a longitudinal channel therewithin. Each of the first handle and second handle have a first end and a second end.

The knife further includes a blade having a tang. The blade further has a central longitudinal axis dividing the blade and tang into a first side and a second side. The blade has a pair of opposing faces and a pair of opposing edges. A portion of the first side of the tang is pivotally secured within the longitudinal channel of the first handle and at the first end of the first handle. A portion of the second side of the tang being pivotally secured within the longitudinal channel of the second handle and within the first end of the second handle. The handles may thereby rotate between a closed position in which the opposing edges of the blade each fit within the channel of one of the handles, and an open position wherein the handles extend away from the blade and substantially parallel to the central longitudinal axis of the blade.

The knife additionally includes a latch having a latch arm with a first end pivotally secured to the second end of the first handle. The latch has a second end with a handle retaining interface thereon. The latch further includes at least one lateral member projecting from a central portion of the latch arm. The second end of the second handle is constrained between the handle retaining interface and the at least one lateral member when the knife is in a latched configuration.

The above needs are further met by a knife, comprising a first handle and a second handle. Each of the first handle and second handle define a longitudinal channel therewithin. Each of the first handle and second handle have a first end and a second end.

The knife includes a blade having a tang. The blade further has a central longitudinal axis dividing the blade and tang into a first side and a second side. The blade has a pair of opposing faces and a pair of opposing edges. A portion of the first side of the tang is pivotally secured within the longitudinal channel of the first handle and at the first end of the first handle. A portion of the second side of the tang is pivotally secured within the longitudinal channel of the second handle and within the first end of the second handle. The handles may thereby rotate between a closed position in which the opposing edges of the blade each fit within the channel of one of the handles, and an open position wherein the handles extend away from the blade and substantially parallel to the central longitudinal axis of the blade;

The knife further includes a latch having a latch arm with a first end pivotally secured to the second end of the first handle. The latch includes a second end with a handle retaining interface thereon. The first handle has a latch blocking member extending from a portion of the first handle, adjacent to the latch. The latch blocking member resists pivoting of the latch into a position in which the latch would interfere with movement of the blade into or out of the slot between the grip panels of the first handle.

The above needs are additionally met by a knife. The knife comprises a first handle and a second handle. Each of the first handle and second handle define a longitudinal channel therewithin. Each of the first handle and second handle have a first end and a second end.

The knife further includes a blade having a tang. The blade further has a central longitudinal axis dividing the blade and tang into a first side and a second side. The blade has a pair of opposing faces and a pair of opposing edges. A portion of the first side of the tang is pivotally secured within the longitudinal channel of the first handle and at the first end of the first handle. A portion of the second side of the tang is pivotally secured within the longitudinal channel of the second handle and within the first end of the second handle. The handles may thereby rotate between a closed position in which the opposing edges of the blade each fit within the channel of one of the handles, and an open position wherein the handles extend away from the blade and substantially parallel to the central longitudinal axis of the blade. At least one of the blade and each handle includes an integral washer surrounding a pivot aperture for each pivotal connection between the blade and each handle.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
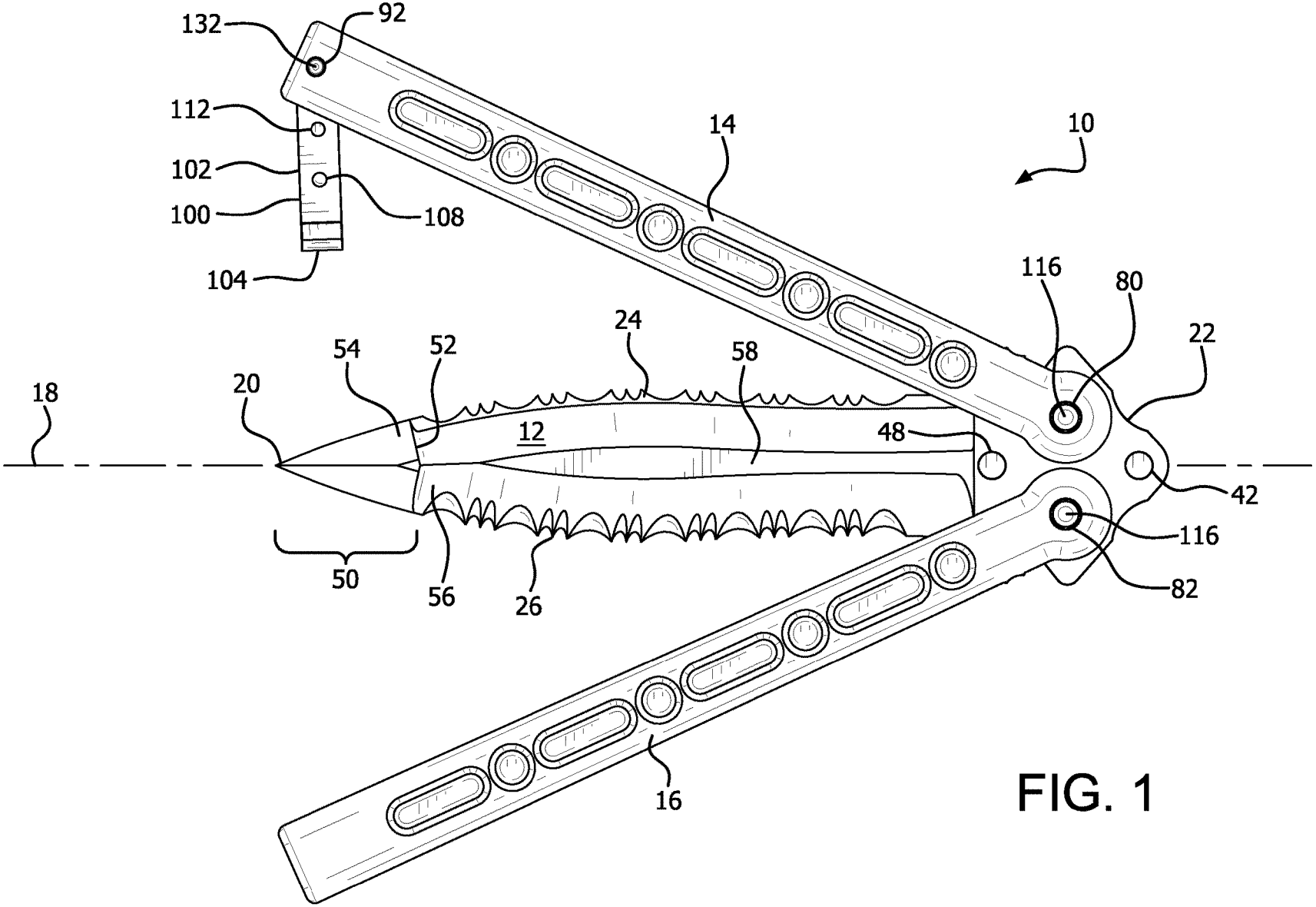
FIG. 1 is a perspective view of an example of a Balisong knife.

Referring to the drawings, there is shown a balisong knife 10. Referring to FIG. 1, the knife 10 includes a blade 12 a first handle 14 pivotally secured to the blade 12, and a second handle 16 pivotally secured to the blade 12.

Figure 2:
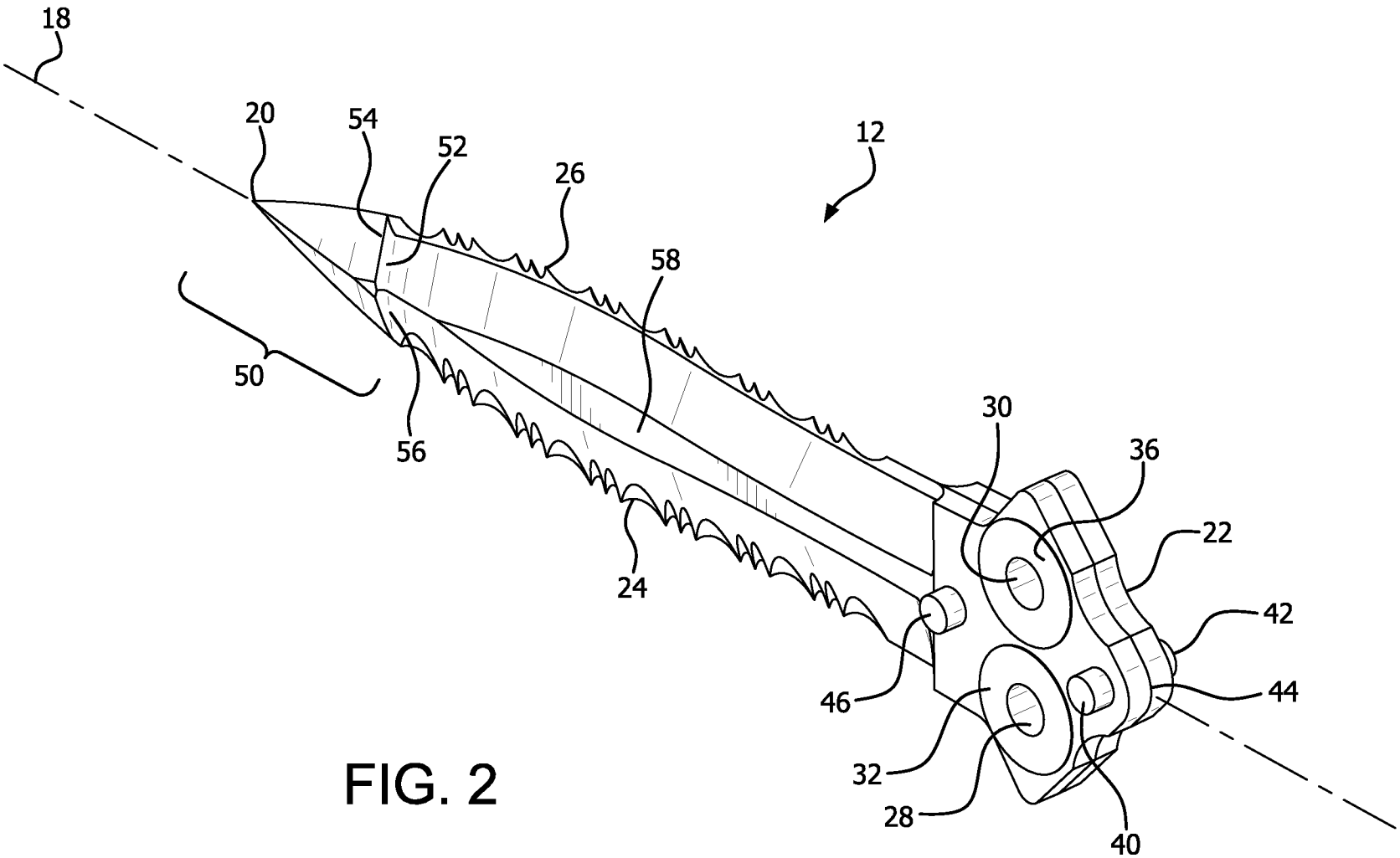
FIG. 2 is a perspective view of a blade for the knife of FIG. 1.
Figure 3:
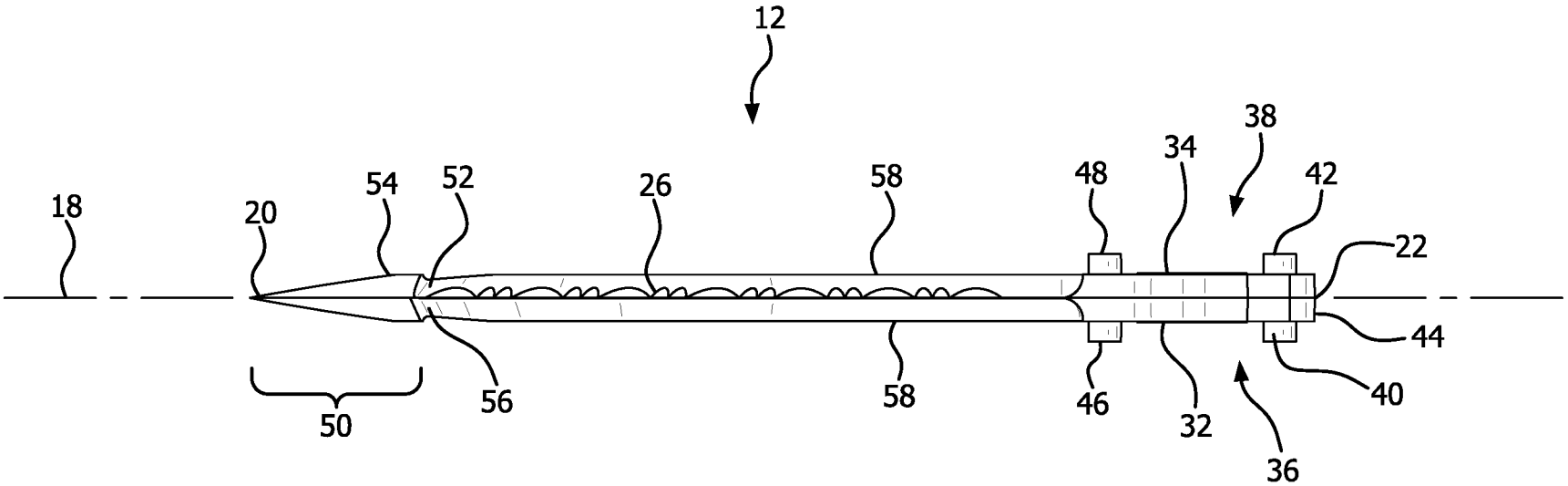
FIG. 3 is a side edge view of the blade of FIG. 2.

As shown in FIGS. 1-3, the blade 12 has a central longitudinal axis 18 passing through the middle of the blade across its width, dividing the blade into two sides, a point 20, a tang 22, a first edge 24, and a second edge 26. In the illustrated example, both the edge 24 and the edge 26 are sharpened. In other examples, only one of the edges, for example only the edge 24, may be sharpened, resulting in a single-edge knife. In some examples of single edge knives, the point may be located on one side or the other side of the central axis rather than along the central axis, depending on the style of blade. In the illustrated example, the edges 24 and 26 are both serrated. In other examples, only one of the edges 24, 26 is serrated, or in some examples neither edge 24, 26 is serrated. In still other examples, each of the edges 24, 26 may include serrated and unserrated portions.

The tang 22 of the blade 12 includes a first aperture 28 and second substantially identical aperture 30, with the first aperture 28 being disposed on the same side of the longitudinal axis 18 as the first edge 24, and the second aperture 30 being disposed on the same side of the longitudinal axis 18 as the second edge 26. The illustrated example of the aperture 28 is surrounded on either face of the blade 12 by integral washer surfaces 32, 34 which are substantially parallel to each other. As used herein, substantially parallel means sufficiently parallel so that any deviations from parallel are insufficient to create any appreciable resistance to rotation of the handles 12 with respect to the blade 12. Similarly, the illustrated example of the aperture 30 is surrounded on either face of the blade 12 by integral washer surfaces 36, 38, which are substantially parallel to each other. Each of the washer surfaces 32, 34, 36, 38 is substantially smooth. As used herein, substantially smooth means that any surface irregularities are sufficiently small so that they do not add any appreciable resistance to rotation of the handles 12 with respect to the blade 12.

Continuing to refer to FIGS. 1-3, the illustrated example of the blade also includes a first pair of pins 40, 42 protruding from either face of the blade 12, along the longitudinal axis 18 of the blade 12, between the apertures 28, 30 and the end 44 of the tang 22. A second pair of pins 46, 48 protrude from either face of the illustrated example of the blade 12, along the longitudinal axis 18. The pins 46, 48 are disposed between the apertures 28, 30 and the point 20, but are proximate to the apertures 28, 30. In the illustrated example, the pins 42, 44, 46, 48 are integrally formed with the blade 12. Other examples could potentially utilize a single pin passing through a hole in the blade to form the pins 42, 44, and/or another single pin passing through a hole in the blade to form the pins 46, 48, without departing from the invention.

The illustrated example of the blade 12 includes reinforcing structures defined thereon. The illustrated blade 12 includes a reinforced point portion 50 adjacent to the point 20. The reinforced point portion 50 is defined between a ledge 52 and the point. This ledge 52 results from the reinforced point portion 50 having a portion 54 with greater thickness immediately forward (towards the point) of the ledge 52 than the blade portion 56 immediately behind (towards the tang) the ledge 52, with the reinforced point portion 50 tapering towards the point. This configuration results in a thicker reinforced point portion 50 for strengthening the point 20, while permitting the first and/or second edges 24, 26 to have a thinner profile for more effective cutting. The illustrated example of the blade 12 also includes a reinforcing spine 58. In the illustrated double edge blade, the reinforcing spine 58 corresponds to the longitudinal axis 18 of the blade 12. In the case of a single edge blade, the reinforcing spine 58 may be disposed along one of the edges 24, 26, most typically the second edge 26, and may extend towards a central portion of the blade. Alternatively, other examples of single edge blades may include a reinforcing spine disposed between one of the edges 24,26 and the reinforcing spine 58.

Figure 4:
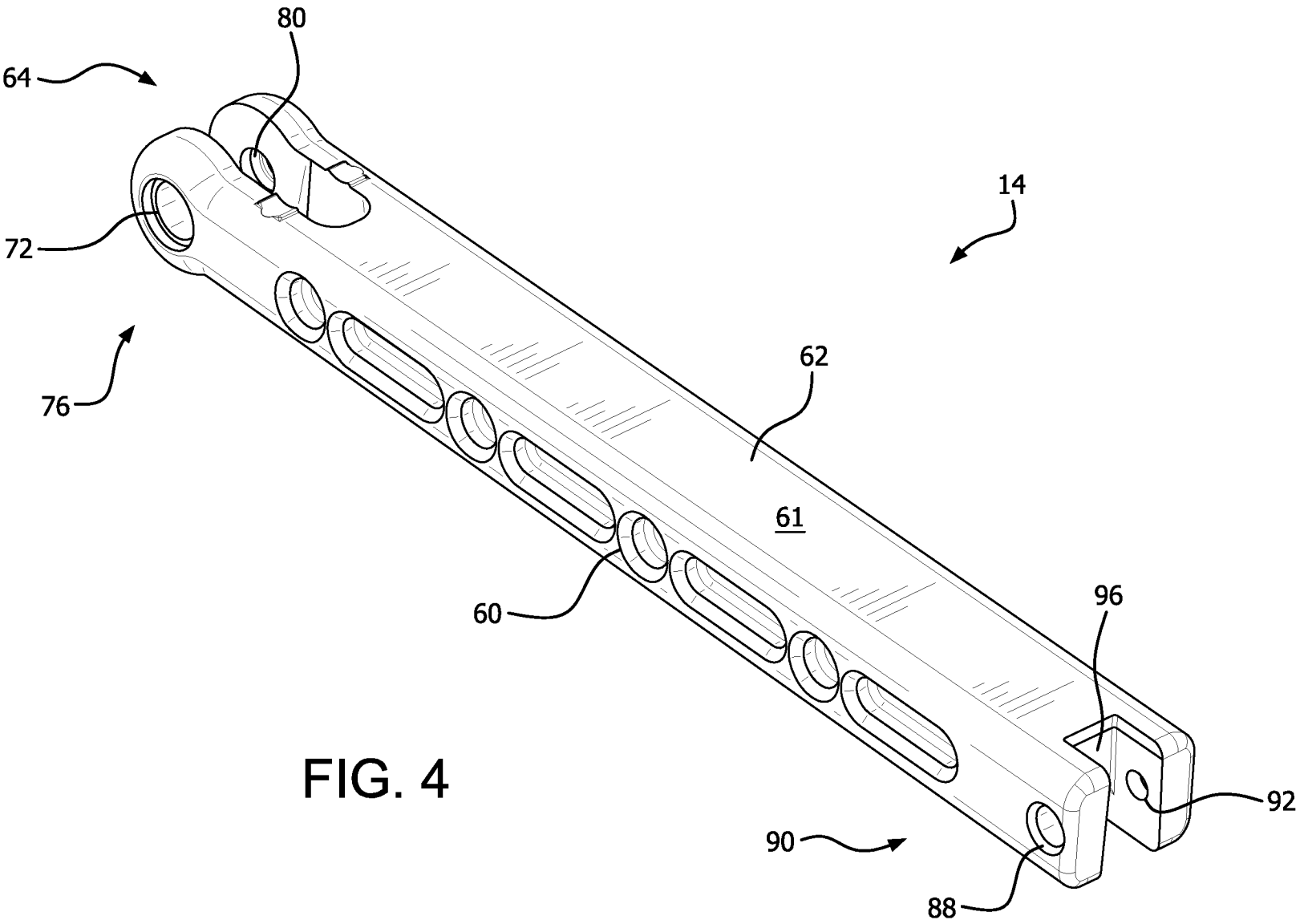
FIG. 4 is a perspective view of a first handle for the knife of FIG. 1.
Figure 5:
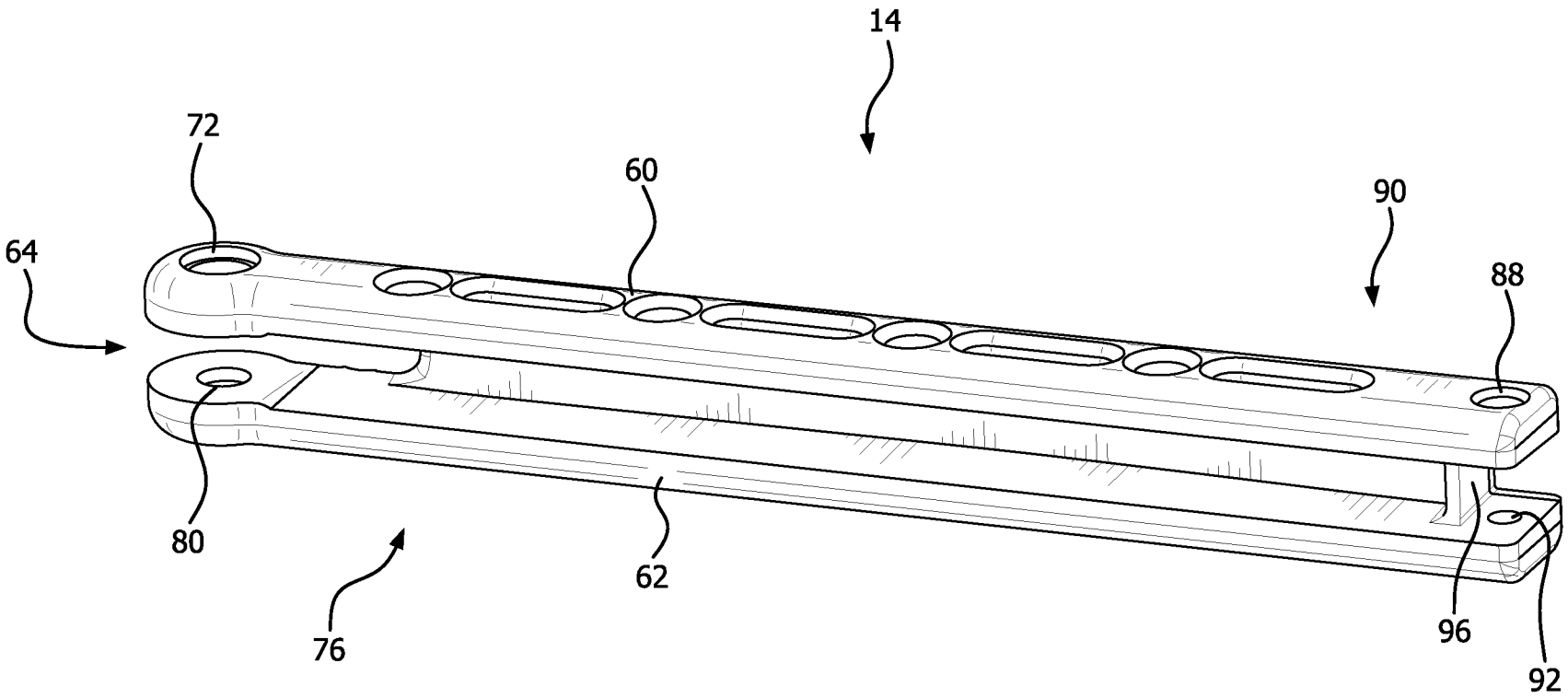
FIG. 5 is another perspective view of the first handle of FIG. 4.
Figure 6:
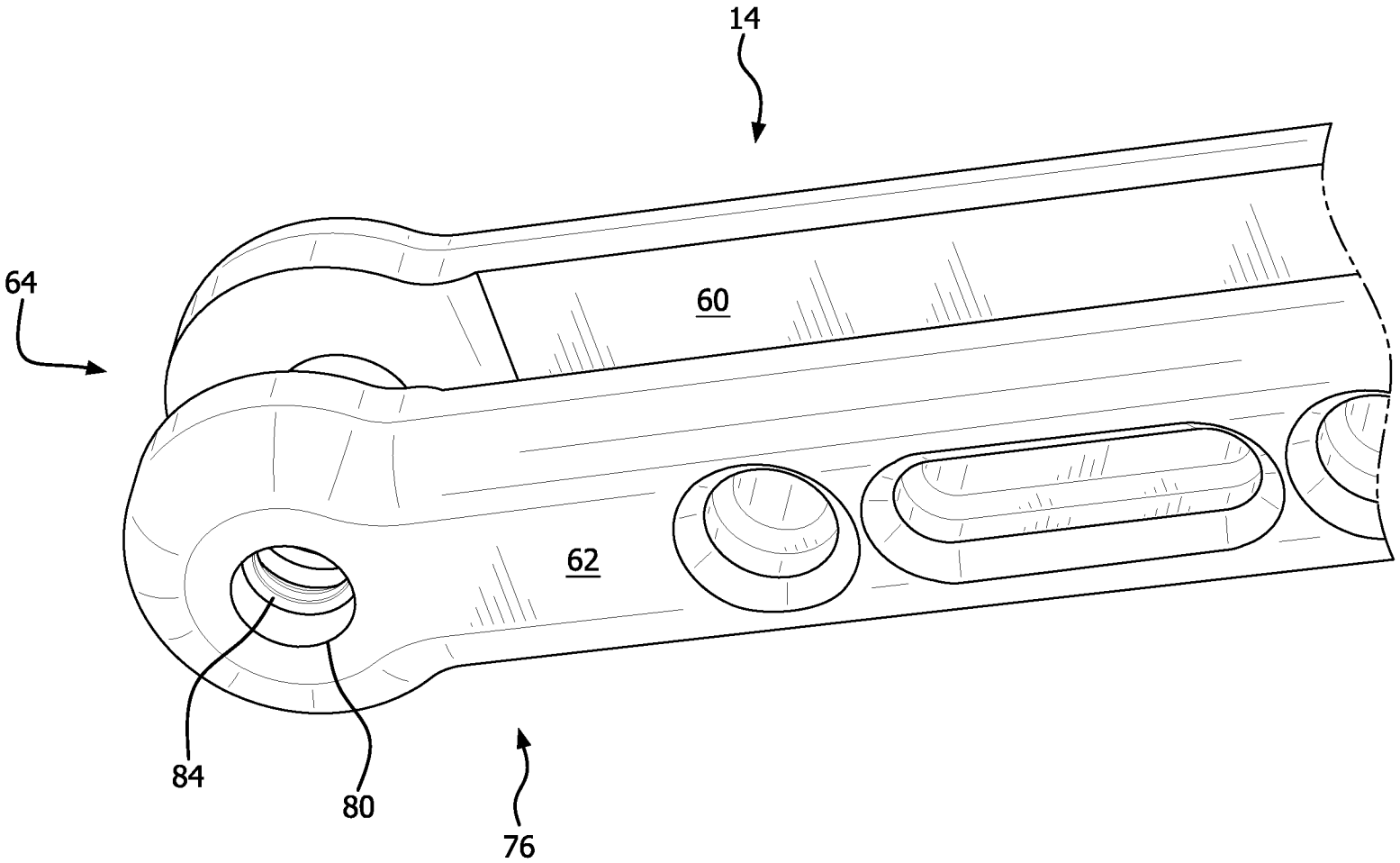
FIG. 6 is a perspective view of a forward portion of the first handle of FIG. 4
Figure 8:
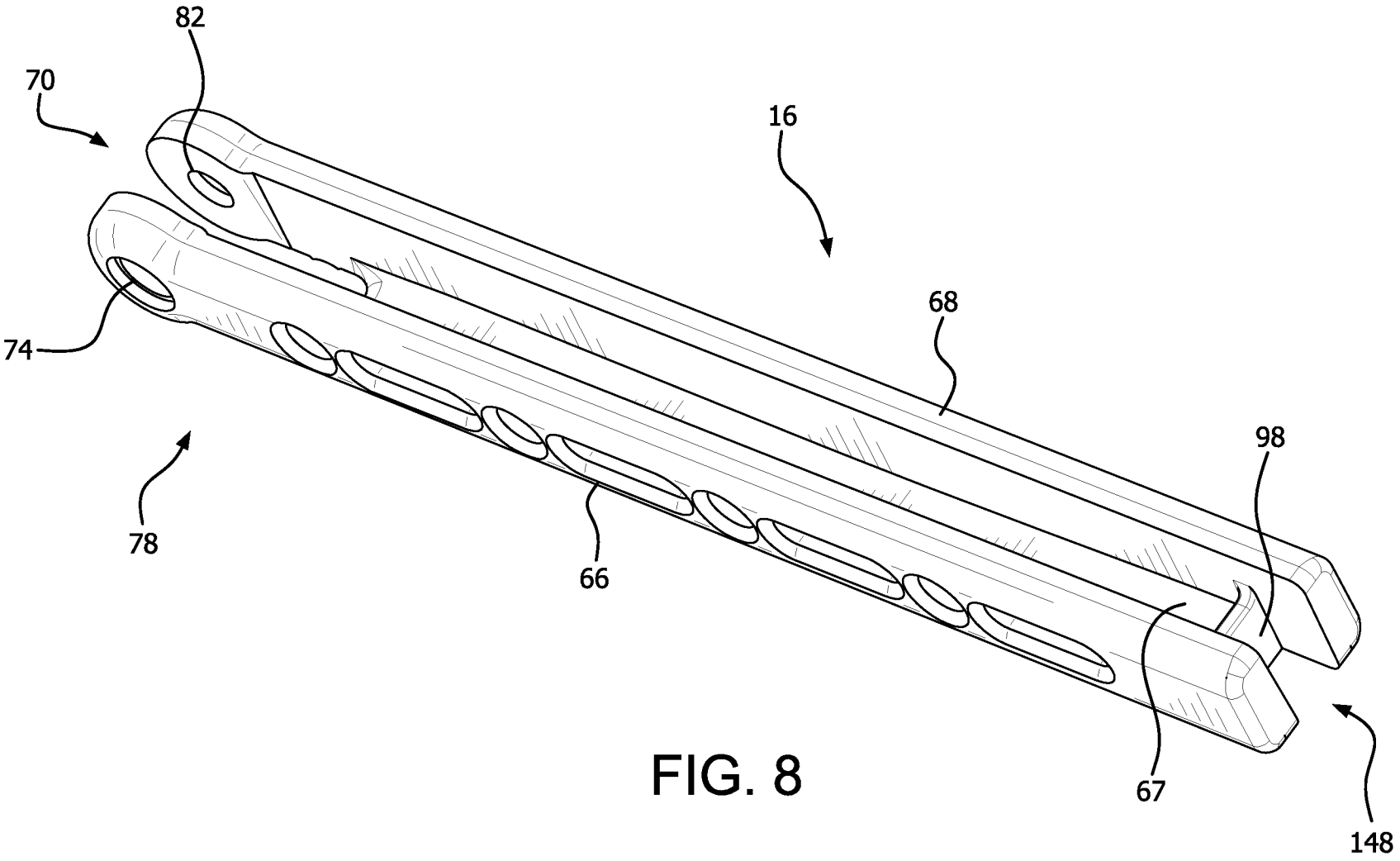
FIG. 8 is a perspective view of a second handle for the knife of FIG. 1.
Figure 9:
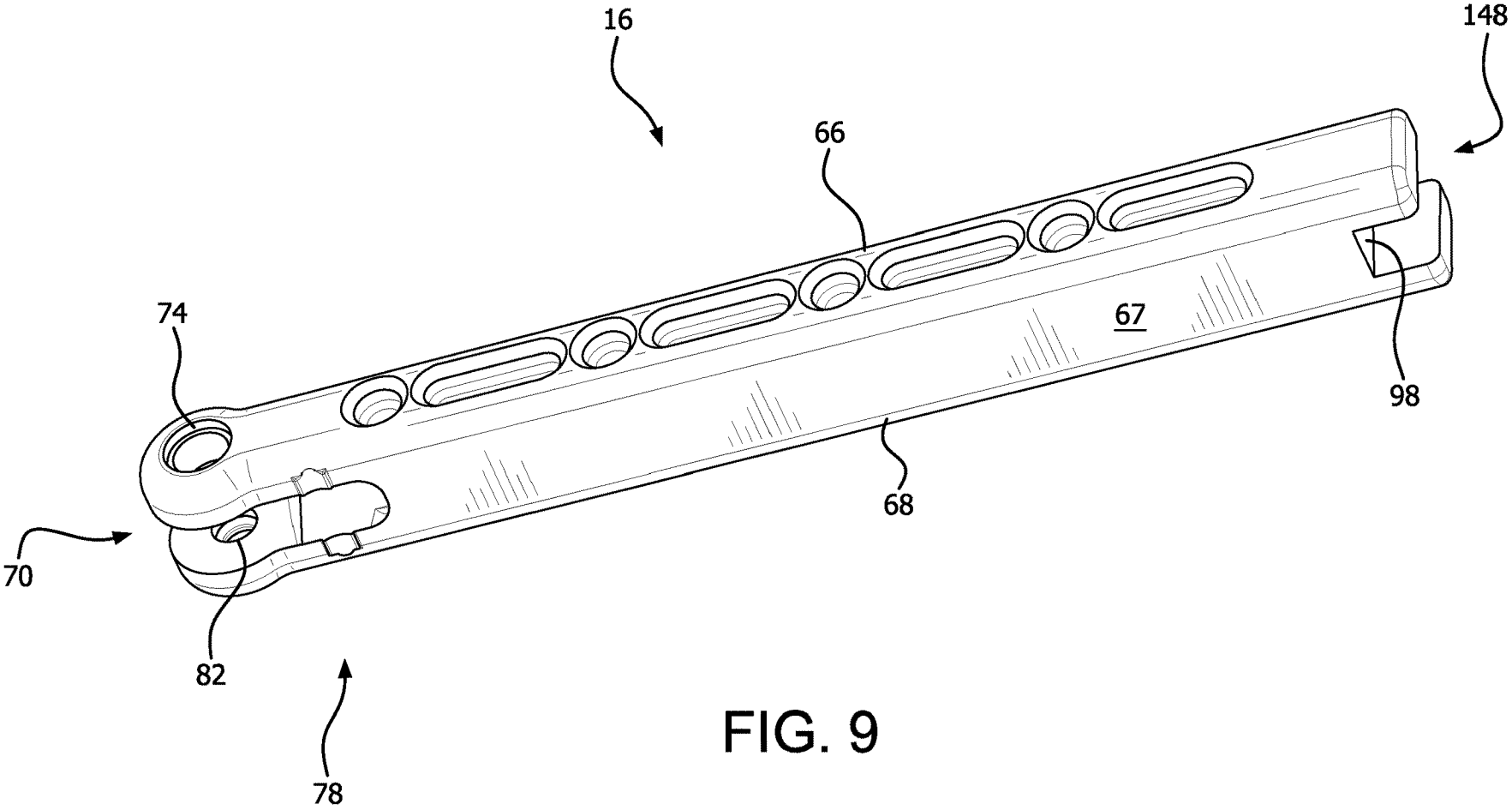
FIG. 9 is another perspective view of the second handle of FIG. 8.
Figure 10:
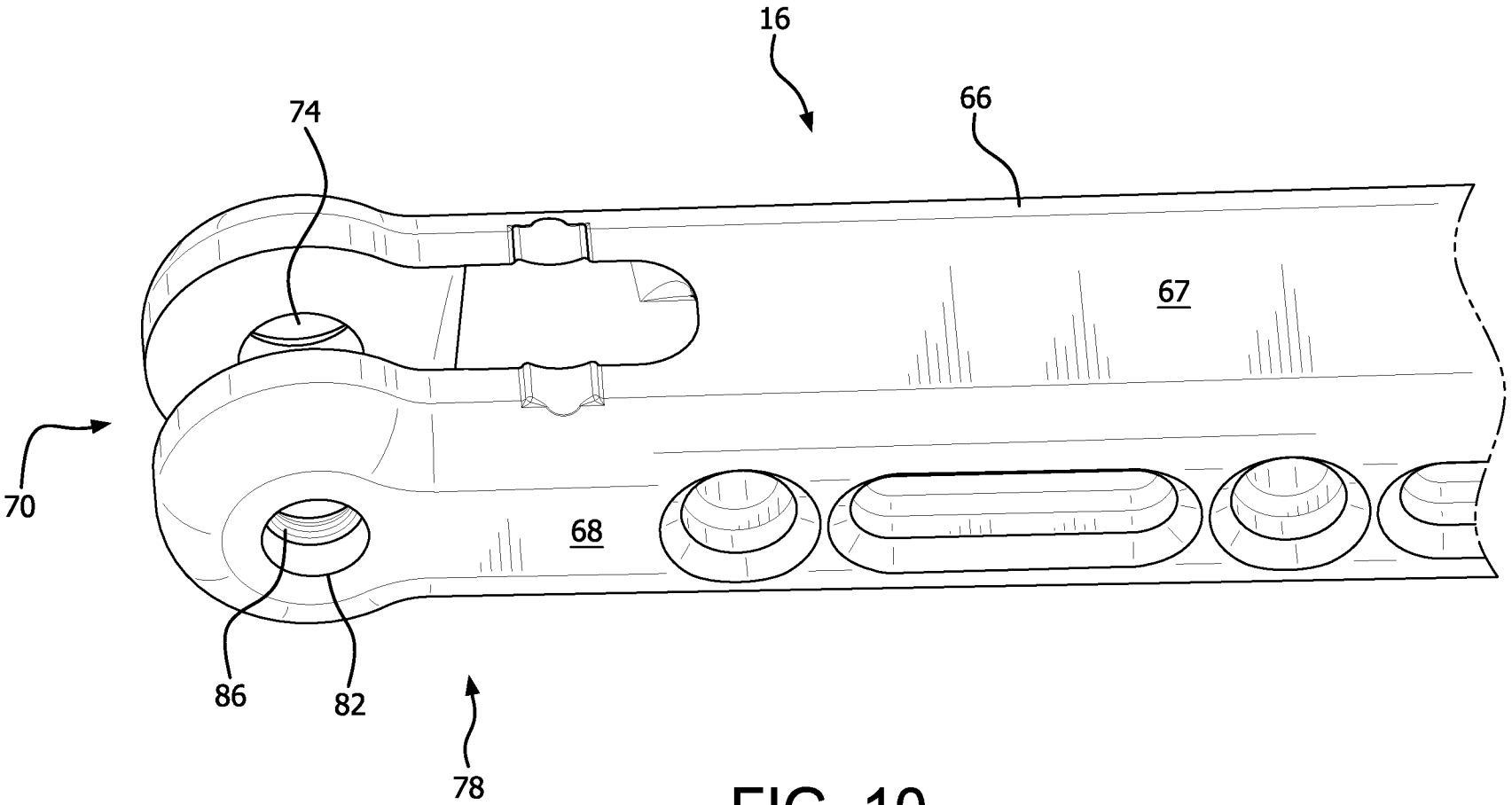
FIG. 10 is a perspective view of a forward portion of the second handle of FIG. 4

Referring to FIGS. 4-10, the first handle 14 (FIGS. 4-7) and second handle 16 (FIGS. 8-10) are mirror images of each other except as described below. The handle 14 includes a first grip panel 60, a second grip panel 62, and a channel 64 therebetween. Similarly, the handle 16 includes a first grip panel 66, a second grip panel 68, and a slot 70 therebetween. The illustrate example of the grip panels 60,62 are held in position with respect to each other by an edge panel 61 extending between the grip panels 60,62 along one edge of the handle 14. Similarly, the illustrate example of the grip panels 66,68 are held in position with respect to each other by an edge panel 67 extending between the grip panels 66,68 along one edge of the handle 16. Each of the slots 64,70 has a width corresponding to the thickness of the blade 12, including the integral washers 32,34,36,38. The grip panels 60,66 each defines an aperture 72,74 at their forward ends 76,78. Each aperture 24,74 includes an outside portion with an enlarged diameter and an internal portion having a diameter that is substantially the same diameter as the apertures 28,30 of the blade 12. The grip panels 62, 68 each define an aperture 80, 82, which are substantially coaxial with the apertures 72,74, respectively. As used herein, substantially coaxial mean sufficiently close to coaxial so that any deviation from perfectly coaxial is insufficient to affect the functioning of the knife 10 to a degree that would be perceived by a user of the knife 10. The apertures 80,82 in the illustrated example have a smaller diameter than the apertures 72,74. Referring to FIGS. 6 and 10, the apertures 80,82 each define a circumferential ridge 84,86, with the diameter of the portion of each aperture 80,82 occupied by the circumferential ridge being smaller than the diameter of the remainder of the apertures 80,82.

Figure 7:
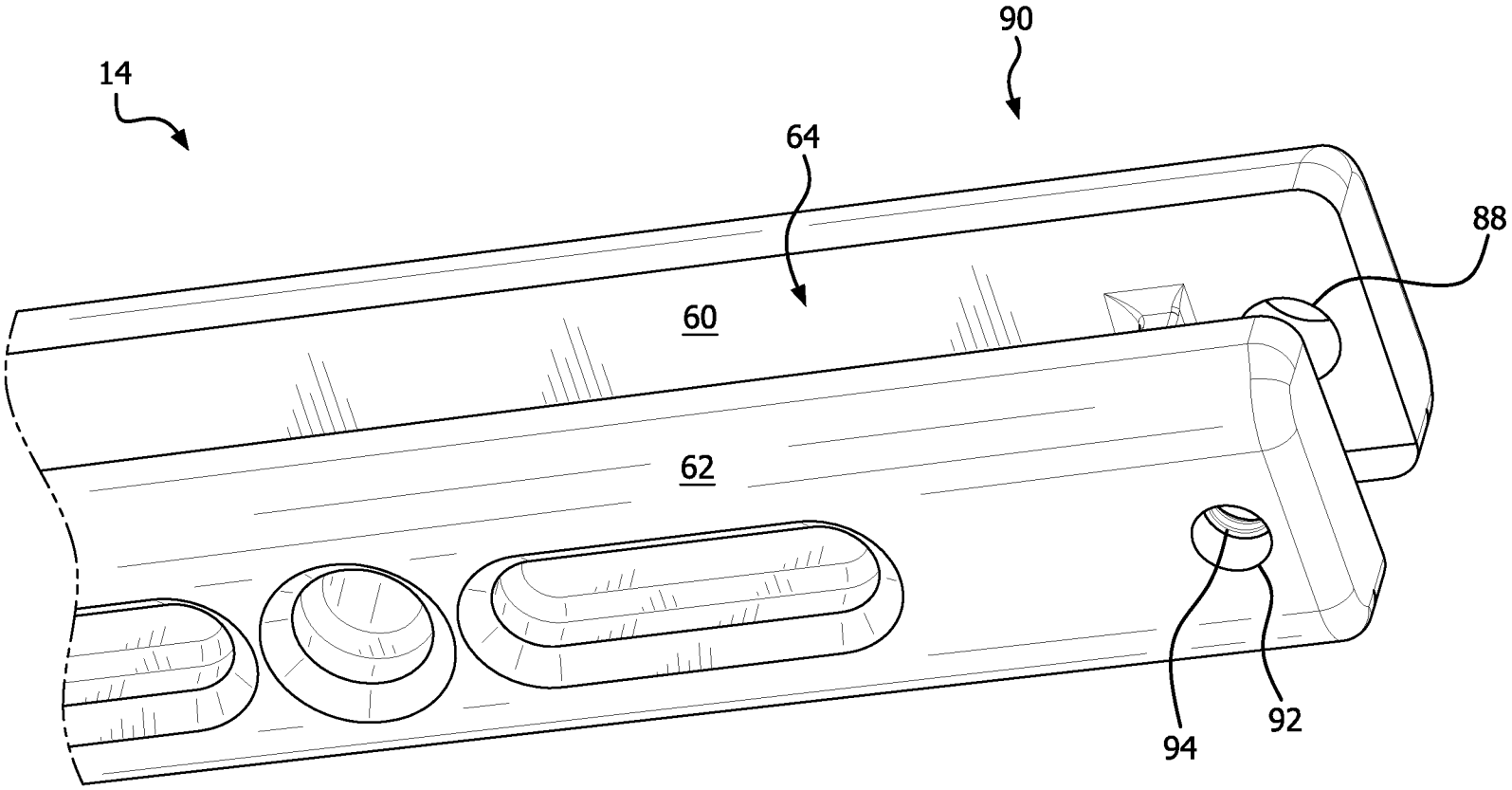
FIG. 7 is a perspective view of a rear portion of the first handle of FIG. 4.

Referring to FIGS. 4-7, the grip panel 60 defines another aperture 88 within its back portion 90. The aperture 88 includes an outside portion with an enlarged diameter and an internal portion having a smaller diameter. The grip panel 62 defines an aperture 92 which is substantially coaxial with the aperture 88. The aperture 92 in the illustrated example has a smaller diameter than the aperture 88. Referring to FIG. 7, the aperture 92 defines a circumferential ridge 94, with the diameter of the portion of the aperture 92 occupied by the circumferential ridge being smaller than the diameter of the remainder of the aperture 92.

Also shown in FIGS. 4-5 and 7, a cross member 96, which in the illustrated example is in the form of a shelf 96, extends between the grip panels 60,62, adjacent to the apertures 88,92. In the illustrated example, the cross member 96 is integrally molded with the handle 14. Other examples could potentially include a cross member that is retained within slots defined within the opposing grip panels, or a pin passing through corresponding apertures defined within the opposing grip panels. A similar cross member 98 is provided within the handle 16, as shown in FIGS. 8-9. Both cross members 96,98 may serve to strengthen the handles 14, 16, and the cross member 96 serves an additional latch movement limiting function that is described in greater detail below.

Figure 11:
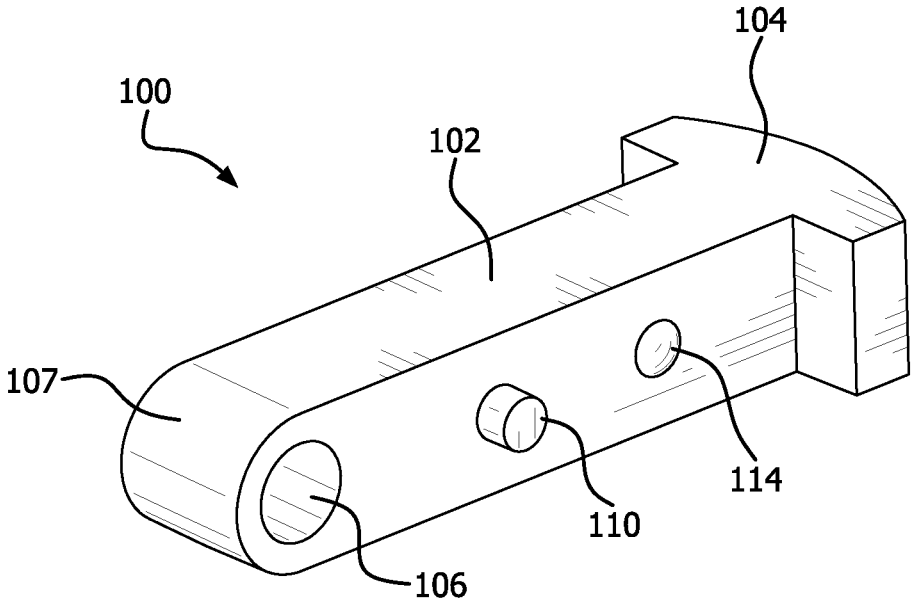
FIG. 11 is a perspective view of a latch for the knife of FIG. 1.
Figure 12:
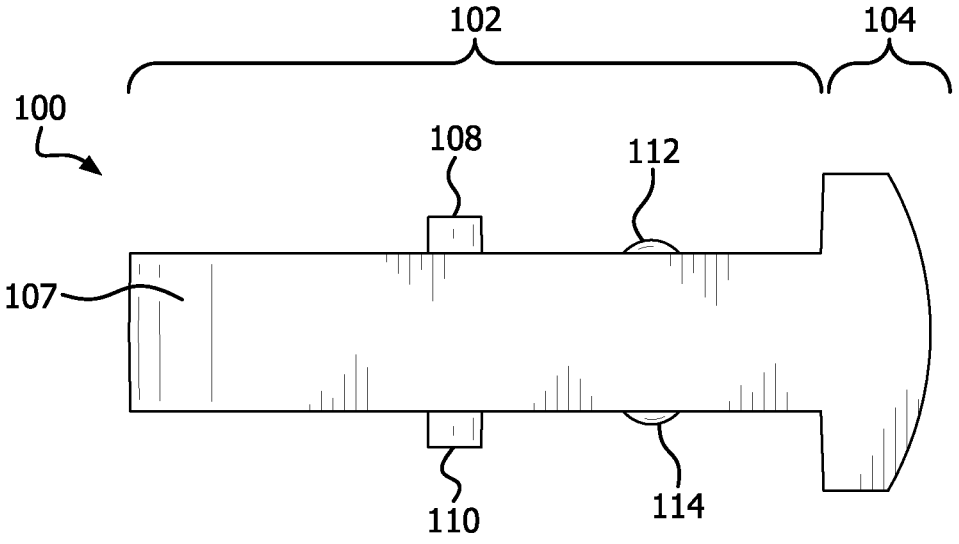
FIG. 12 is a side elevational view of the latch of FIG. 11.

Referring to FIGS. 11-12, the latch 100 is generally T-shaped, defining a latch arm 102 and a handle retaining interface 104 that is substantially perpendicular to the latch arm 102. An aperture 106 passes through the end portion 107 of the latch arm 102 opposite the handle retaining interface 104, and is substantially parallel to the handle retaining interface 104. The aperture 106 is substantially the same diameter is the inner, smallest diameter portion of the aperture 88 in the handle 14. The latch 100 further includes a pair of lateral members 108, 110 extending outward from an intermediate portion of the arm 102, substantially parallel to the aperture 106. In the illustrated example, the lateral members 108, 110 are integrally formed with the latch 100. In other examples, the lateral members 108,110 could potentially be formed by a single pin passing through an aperture in the latch arm 102. Yet another set of protrusions 112,114 are disposed between the lateral members 108,110 and the handle retaining interface 104. The protrusions 112,114 are shorter than the lateral members 108,110. In the illustrated example, the protrusions 112,114 are convex.

Figure 13:
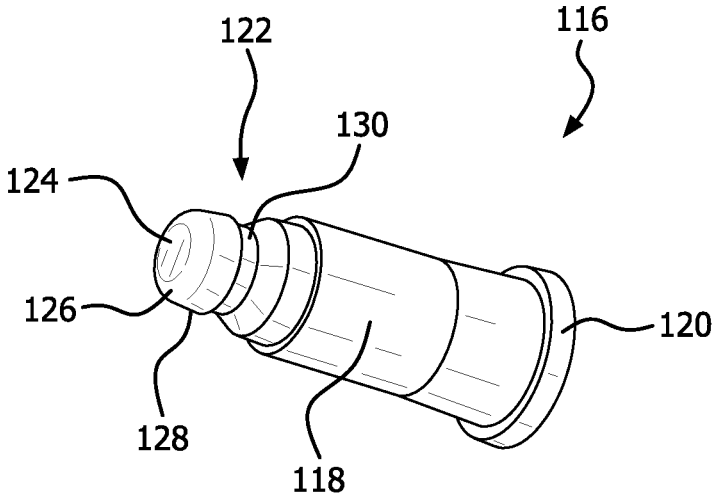
FIG. 13 is a perspective view of a blade/handle pivot pin for the knife of FIG. 1.
Figure 14:
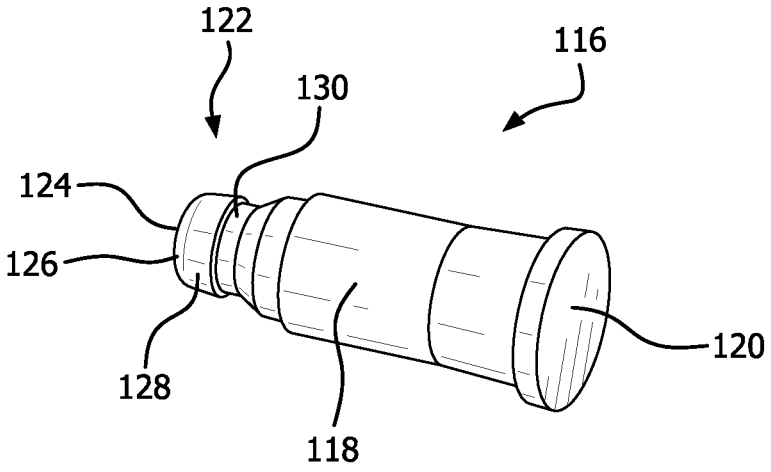
FIG. 14 is another perspective view of the blade/handle pivot pin of FIG. 13.

Referring to FIGS. 13-14, the handles 14, 16 are pivotally secured to the blade 12 by pivot pins 116. In the illustrated example, the pivot pins 116 are designed to snap into place, so that once installed, they remain substantially permanently in place. Each pivot pin 116 includes a shaft 118, a head 120, and a snap connector end 122 opposite the head 100. The shaft 118 is substantially the same diameter as the apertures 28,30 defined within the blade 12 and the smallest diameter, interior portions of the apertures 72, 74 in the handles 14, 16, respectively. The head 120 is substantially the same diameter as the outer, larger diameter portion of the apertures 72, 74, to resist passage of the head 120 through the smaller diameter portions of the apertures 72, 74, and to provide a flush fit of the head 120 within the handles 14,16. The snap connector end 122 includes a tip 124 with a tapered outer edge 126, a raised ridge 128, and a smaller diameter portion 130 immediately behind the ridge 128. The diameter of the ridge 128 is substantially the same as the diameter of the apertures 80,82 within the handles 14,16. The diameter of the smaller diameter portion 130 is substantially the same as the diameter of the apertures 80,82 at the location of the circumferential ridges 84,86. Thus, the handles 14,16 are secured to the blade 12 by driving the pins 116 first through the apertures 72,74 in the grip portions 60,66, then the apertures 28,30 in the blade, and finally the apertures 80,82 in the grip portions 62,68. As the tapered surface 126 engages the circumferential ridges 84,86, the material from which the pivot pins 116 are made will deform elastically, permitting the ridge 128 to pass through the circumferential ridges 84,86. Once the ridge 128 has completely passed through the circumferential ridges 84, 86, these ridges will surround the smaller diameter portion 130, so that the interaction of the ridges 128, 84,86 retains the pins 116 in place.

Figure 15:
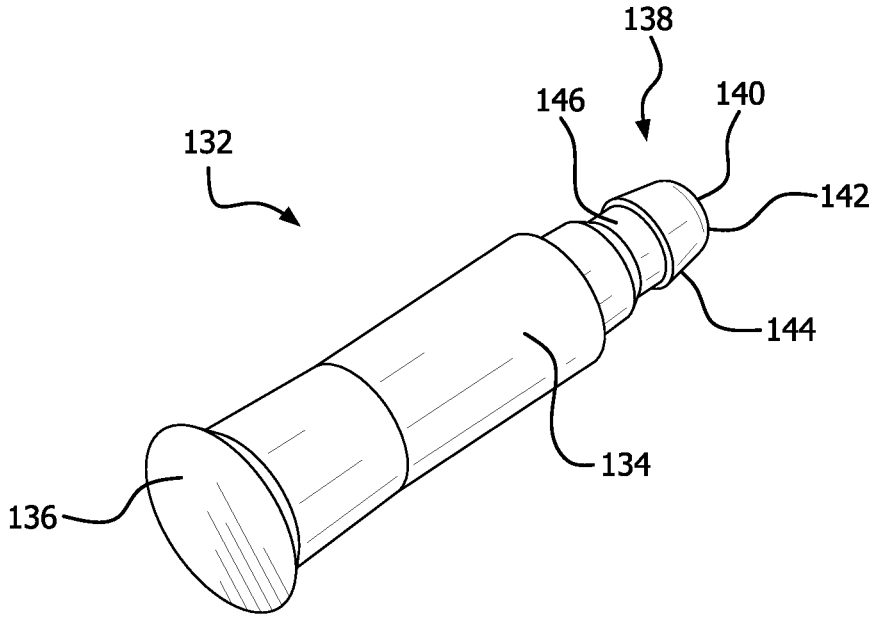
FIG. 15 is a perspective view of a latch/handle pivot pin for the knife of FIG. 1.
Figure 16:
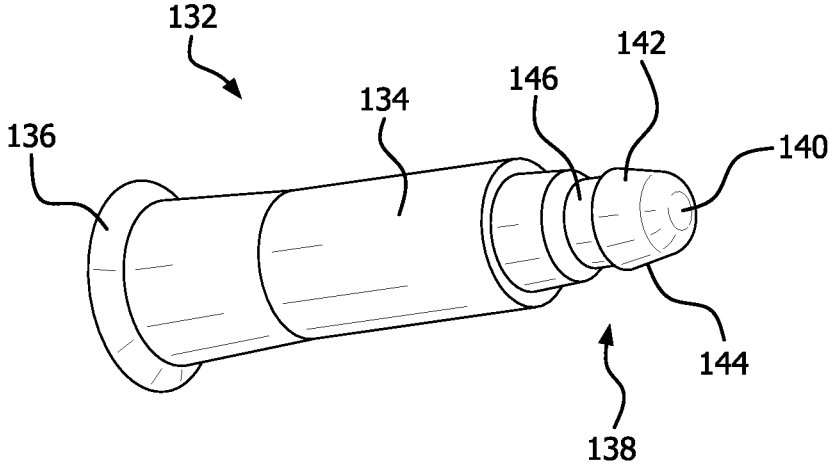
FIG. 16 is another perspective view of the latch/handle pivot pin of FIG. 15.

Similarly, as shown in FIGS. 15-16, the latch 100 is pivotally secured to the handle 14 by pivot pin 132. In the illustrated example, the pivot pin 132 is designed to snap into place, so that once installed, it remains substantially permanently in place. Each pivot pin 132 includes a shaft 134, a head 136, and a snap connector end 138 opposite the head 134. The shaft 134 is substantially the same diameter as the aperture 106 defined within the latch 100 and the smallest diameter, interior portions of the aperture 88 in the handle 14. The head 134 is substantially the same diameter as the outer, larger diameter portion of the aperture 88, to resist passage of the head 134 through the smaller diameter portions of the aperture 88, and to provide a flush fit of the head 134 within the handle 14. The snap connector end 138 includes a tip 140 with a tapered outer edge 142, a raised ridge 144, and a smaller diameter portion 146 immediately behind the ridge 144. The diameter of the ridge 144 is substantially the same as the diameter of the apertures 92 within the handle 14. The diameter of the smaller diameter portion 146 is substantially the same as the diameter of the aperture 92 at the location of the circumferential ridges 94. Thus, the latch 100 is secured to the handle 14 by driving the pin 132 first through the aperture 88 in the grip portion 60, then the aperture 106 in the latch 100, and finally the aperture 92 in the grip portion 62. As the tapered surface 142 engages the circumferential ridge 94, the material from which the pivot pin 132 is made will deform elastically, permitting the ridge 144 to pass through the circumferential ridge 94. Once the ridge 144 has completely passed through the circumferential ridge 94, the ridge 94 will surround the smaller diameter portion 146, so that the interaction of the ridges 144, 94 retains the pin 132 in place.

Those skilled in the art of Balisong knives will recognize that the latch 100 fits within a slot 148 (FIGS. 8 and 9) defined within the handle 16, with the handle retaining interface 104 abutting the handle 16 to retain the latch 100 in position, as well as to retain the handles 14, 16 in close proximity to each other. The protrusions 112, 114 fit between the grip panels 66, 68 with a slight compression fit, which may result in some elastic deformation of the protrusions 112, 114, resisting undesired movements of the latch 100 from engagement with the handle 16. Those skilled in the art of Balisongs will also recognize that when the knife 10 is in a closed configuration, the handles 14, 16 are positioned on either side of and in close proximity to the pins 46, 48, defined on the blade 12, and may in some instances abut the pins 46, 48, thus enhancing the rigidity of the knife 10. When the knife 10 is in an open configuration, the handles 14, 16 are positioned on either side of the pins 40, 42 defined on the blade 12, thus enhancing the rigidity with which the blade 12 is held in position during use regardless of whether the knife 10 is in a latched or unlatched configuration.

Figure 17:
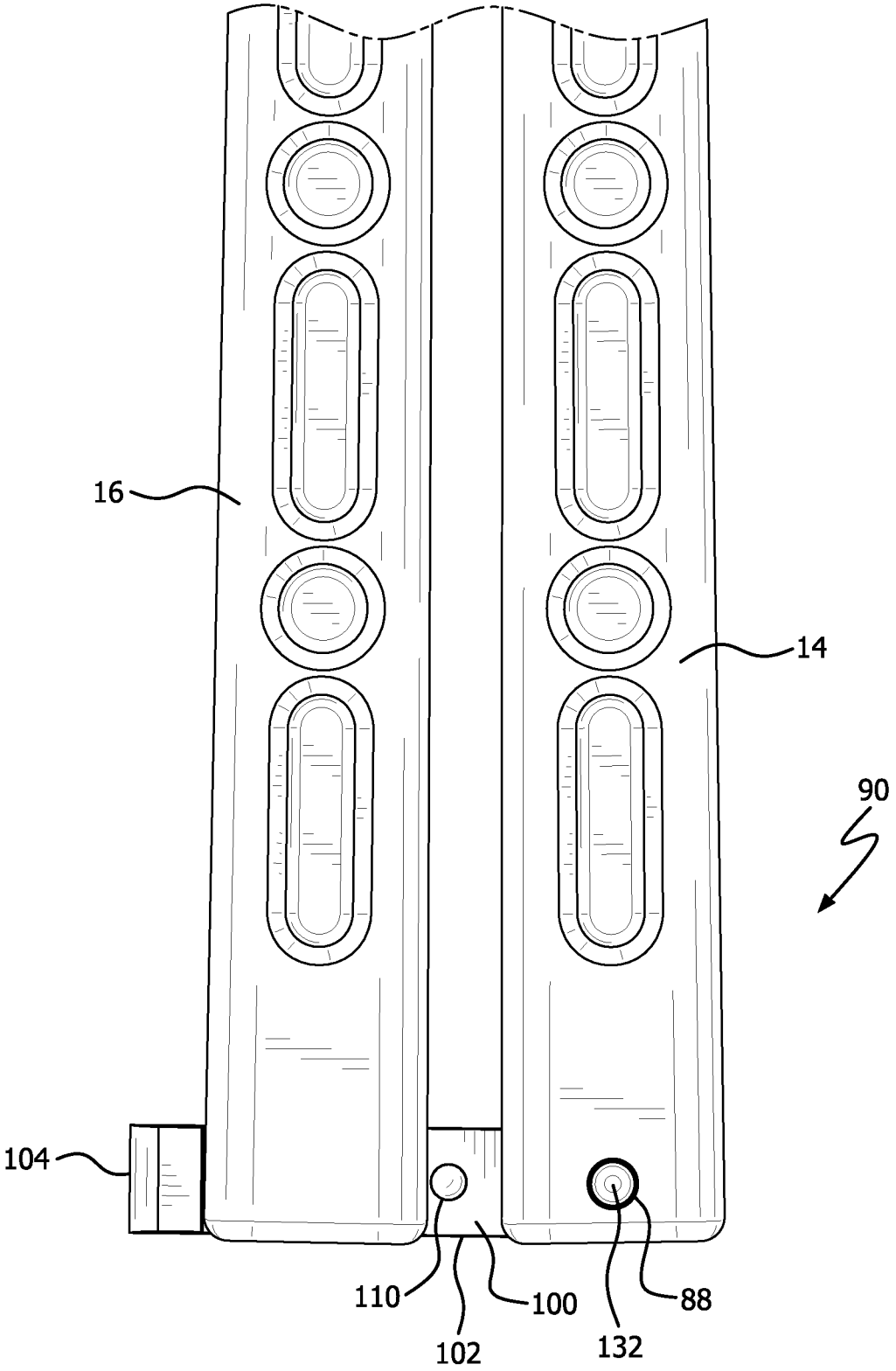
FIG. 17 is a side elevational view of the rear portion of the first and second handles when the knife of FIG. 1 is in a latched open position.
Figure 18:
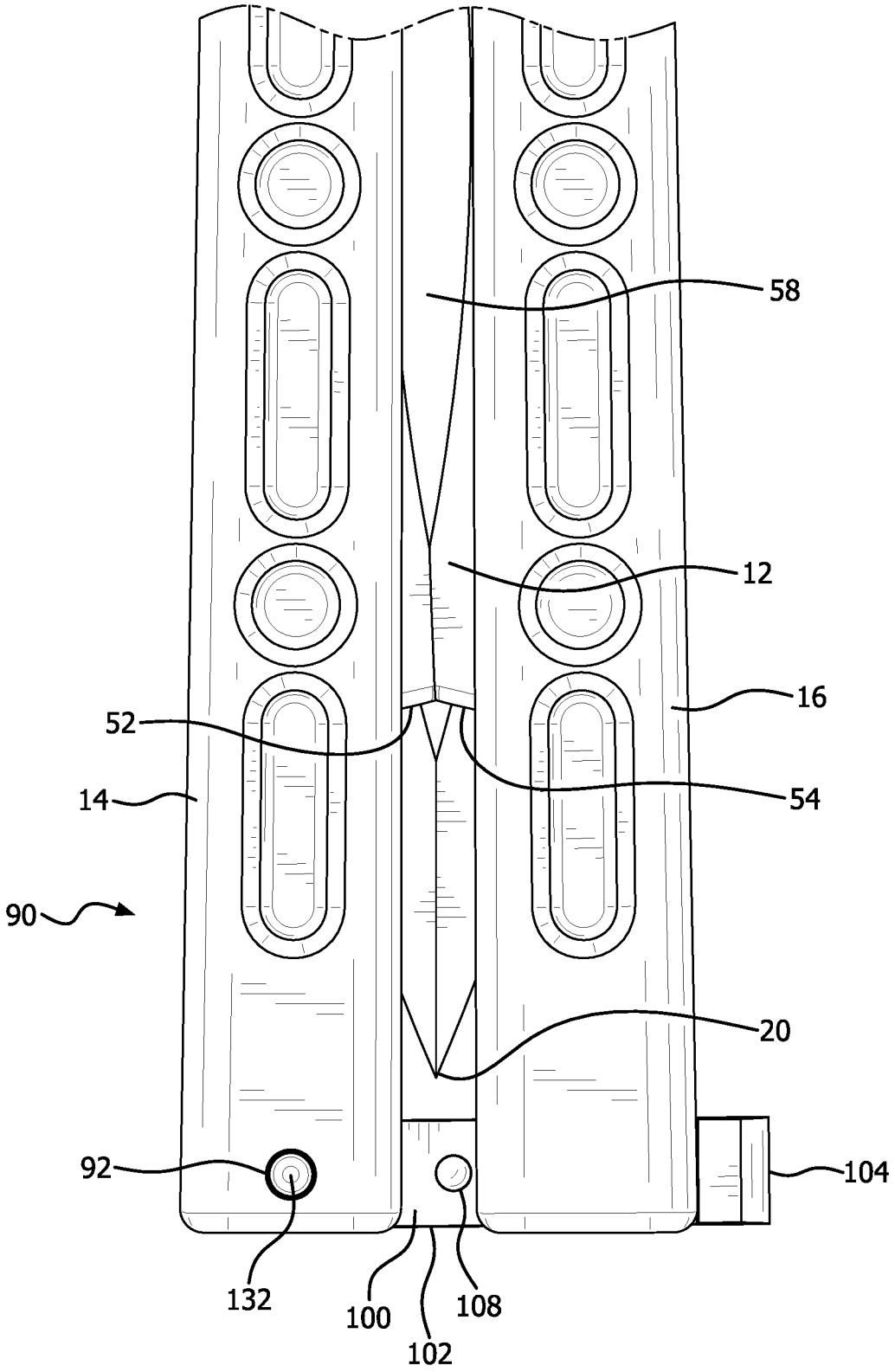
FIG. 18 is a side elevational view of the rear portion of the first and second handles when the knife of FIG. 1 is in a latched closed position.

As shown in FIGS. 11-12 and 17-18, the unique design of the latch 100 and lateral members 108, 110 increase the strength of the handles 14, 16 by resisting the tendency of grip pressure from the user to compress the handles 14, 16 together when the knife 10 is in a latched open configuration. As shown in FIGS. 17-18, when the handles are latched together, the lateral members 108, 110 are in very close proximity to the handle 16, so that slight compression of the handles 14, 16 together will cause the handle 16 to abut the lateral members 108, 110, resisting further compression of the handles 14, 16 together. The handles 14, 16 can be viewed as columns which are hinged (to the blade 12) at their forward end, and which are free at their back and in the unlatched configuration. In the latched configuration, the back ends of the handle 14, 16 are limited to a very small range of movement with respect to each other, with the handle 16 constraint between the handle retaining interface 104 and the lateral members 108, 110.

Those skilled in the art of strength of materials will recognize that the strength of a column can be analyzed by calculating its critical load according to the equation:

$$P=N(EI\pi^2)/L^2$$

Where:
P=critical load
E=modulus of elasticity
L=length
N=number of times strength of hinged columns
Fixed ends N=4
One end fixed, other end hinged N=2
Both ends hinged N=1
One end fixed, other end free N=¼

Thus, limiting the handle 16's movement using the combination of the handle retaining interface 104 and the lateral members 108,110 effectively convert the "columns" formed by the handles 14,16 from columns having one free end to columns having both ends hinged, enabling the handles 14,16 to resist approximately four times the level of force on their ends as would be possible with free back ends.

In the illustrated example of the knife 10, the lateral members 108, 110 do not come in contact with the handle 14 regardless of the position of the latch 100. Thus, the lateral members 108, 110 do not create any friction against the sides or end of the handle 14, maximizing the free rotation of the latch 100 with respect to the handle 14.

Figure 19:
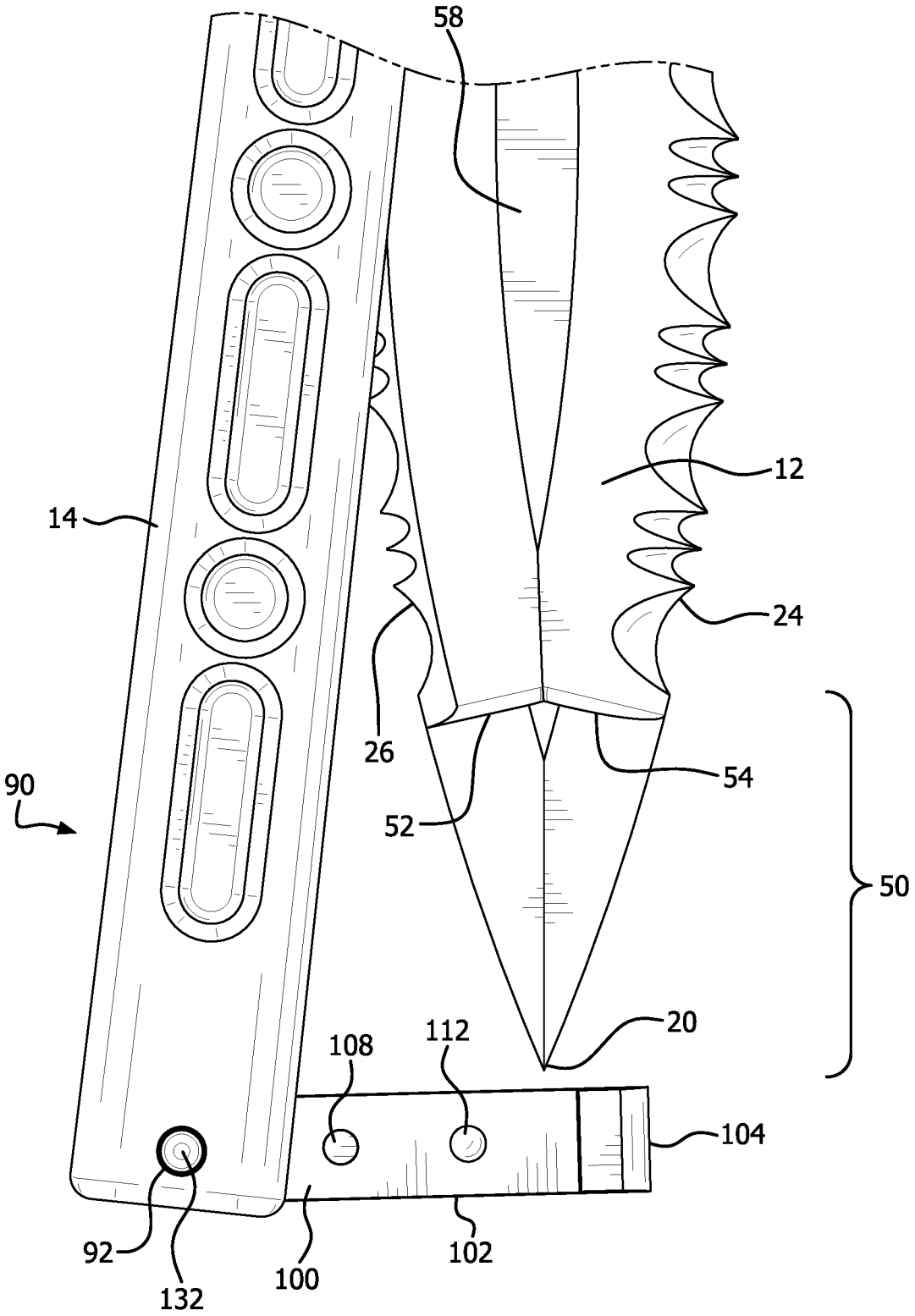
FIG. 19 is a side elevational view of the rear portion of the first and second handles, blade, and latch, showing the positional relationship between the latch and blade.

Referring to FIG. 19, the manner in which interference between the latch 100 and blade 12 is resisted is illustrated. The latch 100 is pivotally secured within the handle 14 adjacent to the crossmember 96. When the blade 12 is relatively close to the channel 64 defined between the grip portion 60, 62, interference between the tip 20 of the blade 12 and the latch 100 would be possible without limiting the movement of the latch 100. The crossmember 96 limits the movement of the latch 100 so that the latch 100 cannot rotate sufficiently close to the tip 20 of the blade 12 to interfere with movement of the blade 12 during opening and closing of the knife. The crossmember 96 does not otherwise restrict rotation of the latch 100, again maximizing free rotation of the latch 100 within its desired range of motion. Although the latch blocking function is served by a cross member in the illustrated example, other examples could potentially utilize a different latch-blocking member, for example, a protrusion disposed outside of the channel.

The knife 10 can be made from a variety of materials that are presently known or may later be developed for use in making knives. These include various metals, polymers, wood, etc. In some examples, different materials may be utilized for the handles 14, 16, the latch 100, the pins 116, 132, and the blade 12. In other examples, the entire knife 10 can be made from a polymer. One example of such a polymer is fiberglass reinforced plastic. In the illustrated example, the handles 14,16 are each integrally made of one-piece construction.

The present invention therefore provides a Balisong knife that can be made entirely from polymer, and which will have increased strength as compared to previously available polymer designs. Compression of the handles together by grip pressure from the user is resisted when the knife is in a latched open configuration, significantly increasing the strength of the handles. Interference between the latch and the tip of the blade is resisted. Both of the above advantages are achieved without adding friction to the rotation of the latch with respect to the first handle. Some examples of the knife 10 may include friction reducing integral washers at the pivotal attachments between the handles and the blade. Other examples of the knife may include variations in thickness, providing increased thickness and strength at the points, while also permitting center edges for cutting. The knife can be quickly, easily, and inexpensively assembled.

A variety of modifications to the above-described embodiments will be apparent to those skilled in the art from this disclosure. For example, the friction reducing integral washers could be included as interior grip panel surfaces instead of, or in addition to being provided on the blade tang. As another alternative, a pivot can be formed utilizing pins that are integral to either a blade or a handle instead of a separate pivot pin passing through both. As yet another alternative, the handles, which are illustrated herein as generally rectangular when viewed from one end, could have a more rounded shape that does not necessarily provide a boundary between the grip panels and the edge panel. Some examples could omit the edge panel entirely. Although the illustrated latch is T-shaped, a latch having a shape that fits outside the second handle rather than within the second handle could be used. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A knife, comprising:

a first handle and a second handle, each of the first handle and second handle defining a longitudinal channel therewithin, each of the first handle and second handle having a first end and a second end;

a blade having a tang, the blade further having a central longitudinal axis dividing the blade and tang into a first side and a second side, the blade having a pair of opposing faces and a pair of opposing edges, a portion of the first side of the tang being pivotally secured within the longitudinal channel of the first handle and at the first end of the first handle, a portion of the second side of the tang being pivotally secured within the longitudinal channel of the second handle and within the first end of the second handle, whereby the handles may rotate between a closed position in which the opposing edges of the blade each fit within the channel of one of the handles, and an open position wherein the handles extend away from the blade and substantially parallel to the central longitudinal axis of the blade; and a latch having a latch arm with a first end pivotally secured to the second end of the first handle, a second end with a handle retaining interface thereon, and at least one lateral member projecting from a central portion of the latch arm, the second end of the second handle being constrained between the handle retaining interface and the at least one lateral member when the knife is in a latched configuration, whereby movement or bending of one of the first handle and second handle towards the other of the first handle or second handle is resisted by the second end of the second handle abutting the at least one lateral member when the knife is in the latched configuration, the at least one lateral member being spaced from the second end of the first handle when the latch is in any position, whereby friction between the at least one lateral member and the second end of the first handle is prevented.

2. The knife according to claim 1, wherein the first handle and second handle are made from polymer.

3. The knife according to claim 2, wherein the entire knife is made from polymer.

4. The knife according to claim 1, further comprising a latch blocking member inside the longitudinal channel defined within the first handle, adjacent to the latch, the latch blocking member resisting pivoting of the latch into a position in which the latch would interfere with movement of the blade into or out of the slot between the grip panels of the first handle.

5. The knife according to claim 4, wherein the latch blocking member is a cross member extending across the channel of the first handle.

6. The knife according to claim 5, wherein the cross member is integral with the handle.

7. The knife according to claim 6, wherein at least one of the blade and each handle includes an integral washer surface surrounding a pivot aperture for each pivotal connection between the blade and each handle, each integral washer surface being formed as one piece with either the blade or one of the handles.

8. The knife according to claim 7, wherein:

the tang of the blade defines a pair of pivot pin receiving apertures extending through the opposing faces, each pin receiving aperture being surrounded on each face by an integral washer surface.

9. The knife according to claim 1, wherein at least one of the blade and each handle includes an integral washer surface surrounding a pivot aperture for each pivotal connection between the blade and each handle, each integral washer surface being formed as one piece with either the blade or one of the handles.

10. The knife according to claim 9, wherein:

the tang of the blade defines a pair of pivot pin receiving apertures extending through the opposing faces, each pin receiving aperture being surrounded on each face by an integral washer surface.

11. A knife, comprising:

a first handle and a second handle, the first handle and second handle each having a first grip panel and a second grip panel, the first grip panel and second grip panel defining a longitudinal channel therewithin, each of the first handle and second handle having a first end and a second end;

a blade having a tang, the blade further having a central longitudinal axis dividing the blade and tang into a first side and a second side, the blade having a pair of opposing faces and a pair of opposing edges, a portion of the first side of the tang being pivotally secured within the longitudinal channel of the first handle and at the first end of the first handle, a portion of the second side of the tang being pivotally secured within the longitudinal channel of the second handle and within the first end of the second handle, whereby the handles may rotate between a closed position in which the opposing edges of the blade each fit within the channel of one of the handles, and an open position wherein the handles extend away from the blade and substantially parallel to the central longitudinal axis of the blade;

at least one of the blade and each handle including an integral washer surface surrounding a pivot aperture for each pivotal connection between the blade and each handle, each integral washer surface being formed as one piece with either the blade or one of the handles.

12. The knife according to claim 11, wherein:

the tang of the blade defines a pair of pivot pin receiving apertures extending through the opposing faces, each pin receiving aperture being surrounded on each face by an integral washer surface.

* * * * *